US007252378B2

(12) United States Patent
Lee

(10) Patent No.: US 7,252,378 B2
(45) Date of Patent: Aug. 7, 2007

(54) INK CARTRIDGE

(75) Inventor: Jae-cheol Lee, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 227 days.

(21) Appl. No.: 10/841,462

(22) Filed: May 10, 2004

(65) Prior Publication Data

US 2005/0041077 A1 Feb. 24, 2005

(30) Foreign Application Priority Data

Aug. 23, 2003 (KR) ..... 10-2003-0058502

(51) Int. Cl.
*B41J 2/175* (2006.01)

(52) U.S. Cl. ..... 347/87

(58) Field of Classification Search ..... 347/85, 347/86, 87; 55/358.1; 29/890.1
See application file for complete search history.

(56) References Cited

U.S. PATENT DOCUMENTS 4,771,295 A * 9/1988 Baker et al. ..... 347/87
5,489,932 A * 2/1996 Ceschin et al. ..... 347/87
6,474,797 B2 * 11/2002 Kurata et al. ..... 347/85
6,490,792 B1 * 12/2002 Ishinaga et al. ..... 29/890.1
6,723,147 B2 * 4/2004 Mashiko et al. ..... 55/385.1
6,840,610 B2 * 1/2005 Taniguchi et al. ..... 347/86

FOREIGN PATENT DOCUMENTS

JP 08-323988 12/1996
JP 2003-182101 7/2003

* cited by examiner

*Primary Examiner*—Anh T. N. Vo
(74) *Attorney, Agent, or Firm*—Roylance, Abrams, Berdo & Goodman, L.L.P.

(57) ABSTRACT

Provided is an ink cartridge. The ink cartridge includes a first chamber, which retains ink and communicates with a print head, a second chamber with an air vent, a third chamber, which includes a first end communicating with the first chamber and a second end communicating with the second chamber and is filled with a porous member creating a negative pressure by capillary action, and selective permeable member installed at the air vent, which allows inflow of air and prevents outflow of the ink.

7 Claims, 6 Drawing Sheets

INK CARTRIDGE

BACKGROUND OF THE INVENTION

This application claims the benefit under 35 U.S.C. § 119(a) of Korean Patent Application No. 2003-58502, filed on Aug. 23, 2003, in the Korean Intellectual Property Office, the entire disclosure of which is incorporated herein by reference.

1. Field of the Invention

The present invention relates to an ink cartridge used in an inkjet recording apparatus.

2. Description of the Related Art

FIG. 1 schematically shows a conventional ink cartridge as disclosed in U.S. Pat. No. 5,877,794.

Referring to FIG. 1, an ink tank 2 and a print head 1 are shown. The ink tank 2 is divided into a main ink chamber 4 containing ink 3 and an auxiliary ink chamber 6 filled with a porous member 9. The main ink chamber 4 communicates with the print head 1 via a first opening 5. The auxiliary ink chamber 6 communicates with the main ink chamber 4 via a second opening 7. The auxiliary ink chamber 6 has an air vent 8. The porous member 9 absorbs the ink 3 through the second opening 7 by capillary action, which maintains the inside of the ink tank 2 to be in a negative pressure state where the internal pressure of the ink tank 2 is lower than the external pressure.

The ink 3 in the main ink chamber 4 is supplied into the print head 1 via the first opening 5 and then ejected from the print head 1. As the ink 3 is consumed, the internal pressure of the main ink chamber 4 decreases. At this time, air coming in through the air vent 8 is introduced into the main ink chamber 4 through the porous member 9. That is, the porous member 9 serves as a pressure buffer between the inside and outside of the main ink chamber 4 by creating capillary pressure.

Ink in an ink cartridge is affected by variations in environmental pressure and temperature. In particular, when environmental temperature and pressure change during transportation, leakage of the ink 3 from the print head 1 or the air vent 8 may occur. For example, in the case of transportation via an airplane in which the environmental pressure can be about 0.7 atmospheres, the internal pressure of the main ink chamber 4 can be higher than the external pressure. Also, in a case where a ship carrying an ink cartridge-containing container transits the equator, the temperature inside the container rises to about 60 to 70 degrees Celsius and the air inside the main ink chamber 4 expands. As a result, the internal pressure of the main ink chamber 4 becomes higher than the external pressure, thereby causing a leakage of the ink 3 from the print head 1 or the air vent 8. The leakage of the ink 3 may also be caused when an ink cartridge is used in adverse conditions in which the internal pressure and the external pressure of the main ink chamber 4 can be reversed. Such leakage of the ink 3 may contaminate the exterior of an ink cartridge and cause high consumption of the ink 3.

SUMMARY OF THE INVENTION

The present invention provides an ink cartridge having a separate internal compartment retaining ink that leaks from a main ink chamber due to a change in external environment. Therefore, external leakage of the ink can be prevented.

According to an aspect of the present invention, there is provided an ink cartridge comprising: a first chamber, which retains ink and communicates with a print head; a second chamber with an air vent; a third chamber, which comprises a first end communicating with the first chamber and a second end communicating with the second chamber and is filled with a porous member creating a negative pressure by capillary action; and a selective permeable member installed at the air vent, which allows inflow of air and prevents outflow of the ink.

BRIEF DESCRIPTION OF THE DRAWINGS

The above and other features and advantages of the present invention will become more apparent by describing in detail exemplary embodiments thereof with reference to the attached drawings in which.

Throughout the drawings, it should be understood that like reference numerals are used to describe like features and structures.

DETAILED DESCRIPTION OF THE EXEMPLARY EMBODIMENTS

Hereinafter, exemplary embodiments of the present invention will be described in detail with reference to the accompanying drawings.

Figure 2:
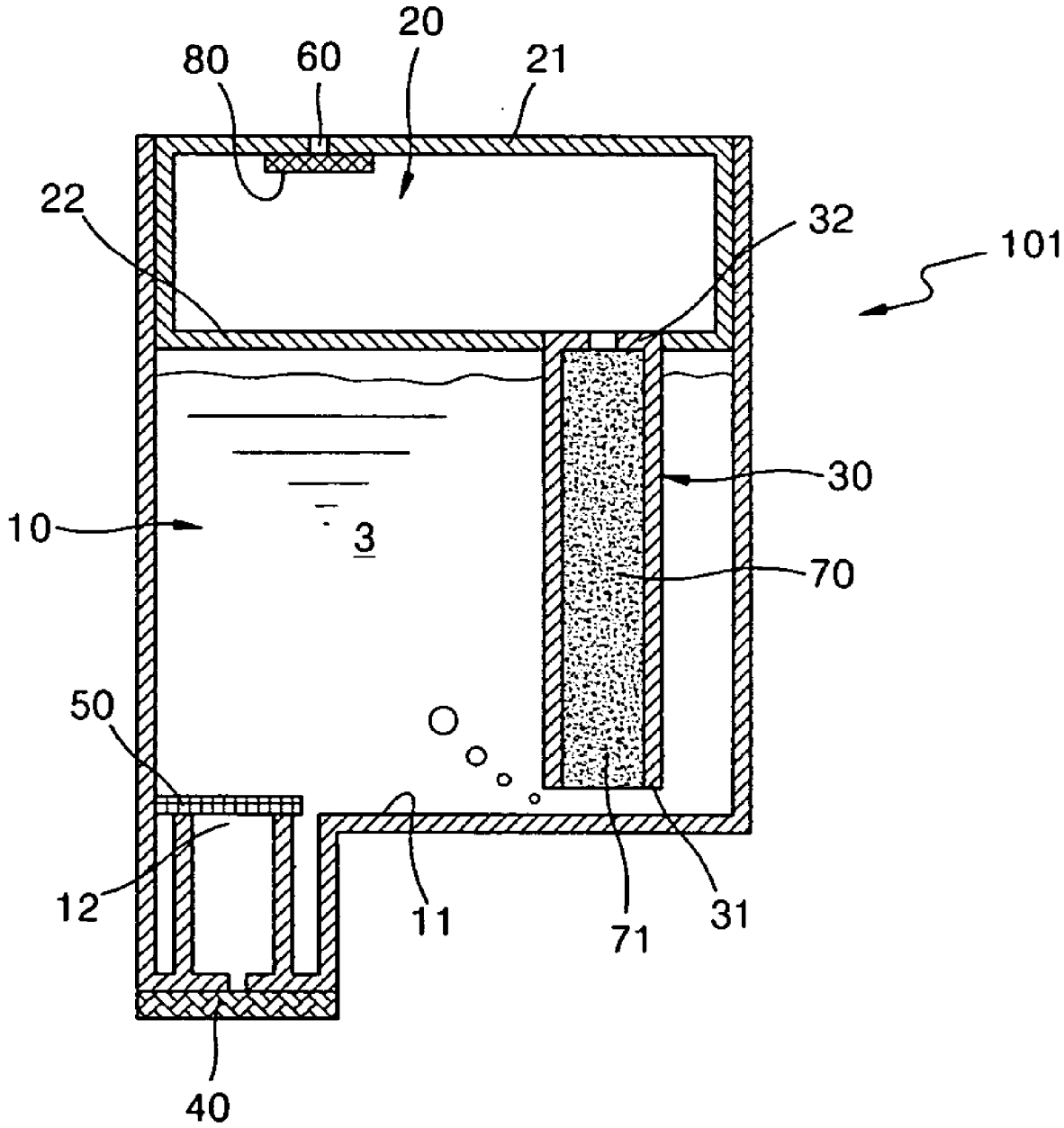
FIG. 2 is a sectional view of an ink cartridge according to an embodiment of the present invention.

FIG. 2 is a sectional view of an ink cartridge according to an embodiment of the present invention. Referring to FIG. 2, an ink cartridge 101 includes first, second, and third chambers 10, 20, and 30. The first chamber 10 retains ink 3 and communicates with a print head 40 through a first opening 12. Preferably, a filter 50 is interposed between the first chamber 10 and the print head 40 to filter the ink 3 to be introduced into the print head 40. Therefore, nozzles (not shown) of the print head 40 are prevented from being clogged by a foreign substance. The second chamber 20 is positioned above the first chamber 10. An upper wall 21 of the second chamber 20 has an air vent 60 communicating with the outside. In this embodiment, a lower wall 22 of the second chamber 20 is a border between the first chamber 10 and the second chamber 20.

The third chamber 30 is filled with a porous member 70 that creates a negative pressure by capillary action. The third chamber 30 includes a first end 31 communicating with the first chamber 10 and a second end 32 communicating with the second chamber 20. Preferably, the first end 31 is separated from a lower wall 11 of the first chamber 10 by a small gap. An end 71 of the porous member 70 is separated from the lower wall 11 of the first chamber 10 by a small gap or can also be in contact with the lower wall 11 of the first chamber 10.

The air vent 60 is provided with selective permeable member 80 that allows inflow of outside air and prevents outflow of the ink 3. The selective permeable member 80 is preferably made of a material that has selective permeability according to the particle size of a fluid, such as Gore-Tex. Gore-Tex allows air to flow through while preventing the passage of the ink 3 with a relatively large particle size. A check valve (not shown) may also be used as the selective permeable member 80 since it allows the inflow of a fluid into the second chamber 20 while preventing the outflow of a fluid from the second chamber 20.

At an early stage, the inside of the first chamber 10 is maintained to be in a negative pressure state where the internal pressure of the first chamber 10 is slightly lower than the external pressure (atmospheric pressure), to prevent leakage of the ink 3. As the ink 3 is ejected from the print head 40, the level of the ink 3 in the first chamber 10 becomes lower. The internal pressure of the first chamber 10 also becomes lower accordingly. When the internal pressure of the first chamber 10 is lower than the capillary pressure created by the porous member 70, air coming from the air vent 60 is introduced into the first chamber 10 through the porous member 70. By doing so, even when the ink 3 is continuously being consumed, the internal pressure of the first chamber 10 is not lowered further, thereby reaching an equilibrium pressure at which the internal pressure of the first chamber 10 and the capillary pressure of the porous member 70 are balanced. Since the porous member 70 has a tendency to retain the ink 3 by capillary pressure, even when the ink cartridge 101 turns upside down, the ink 3 in the first chamber 10 is substantially prevented from flowing into the second chamber 20.

Figure 1:
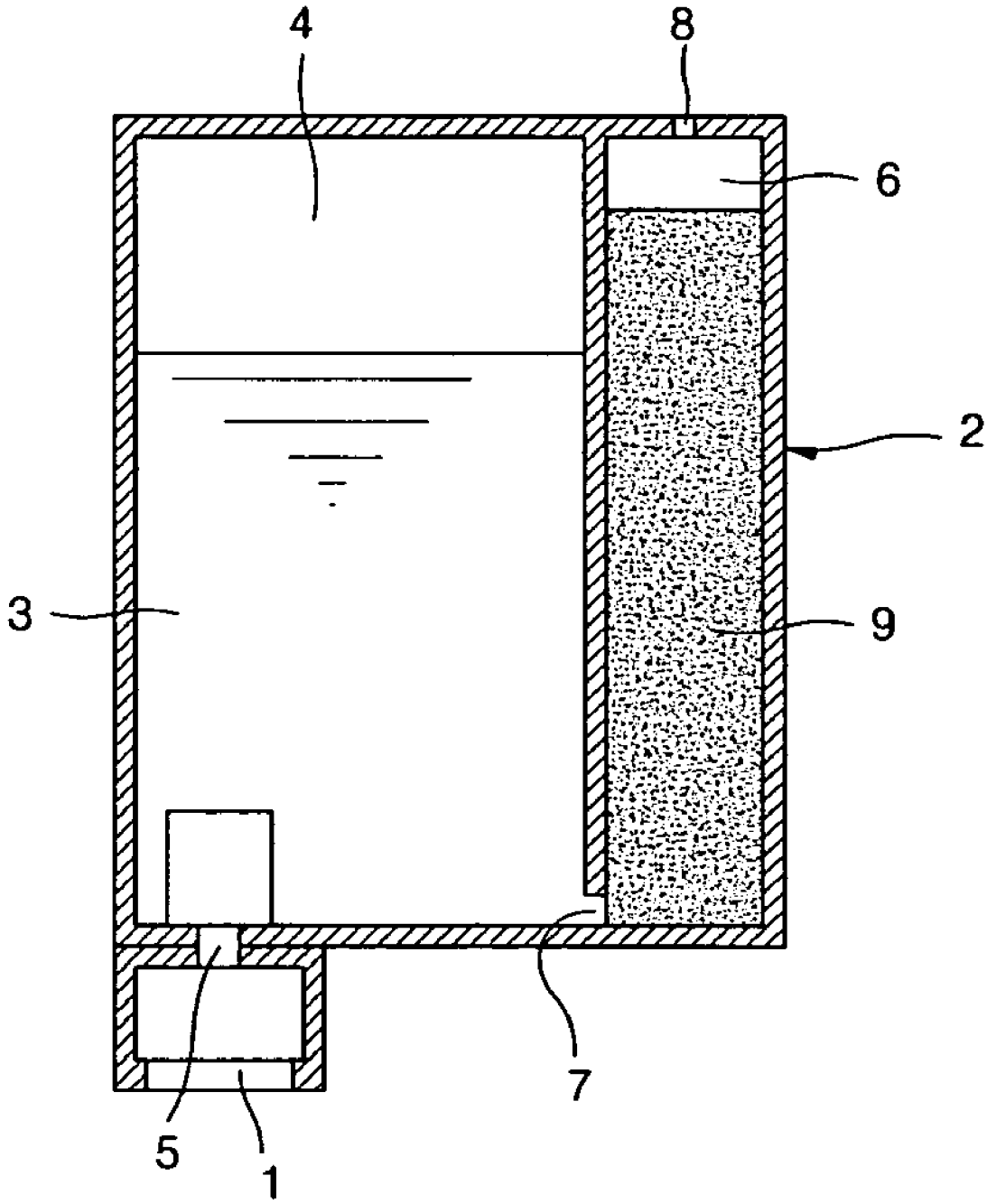
FIG. 1 (PRIOR ART)
FIG. 1 is a schematic sectional view of a conventional ink cartridge.

The performance of an ink cartridge 101 in accordance with an embodiment of the present invention in transportation and use environments will now be described. For example, in the case of transportation via airplane in which the environmental pressure is about 0.7 atmospheres, the internal pressure of the first chamber 10 may become higher than the external pressure. Also, during transportation and use in a high temperature environment, air inside the first chamber 10 expands, and thus, the internal pressure of the first chamber 10 can become higher than the external pressure. Under these circumstances, in the conventional ink cartridge of FIG. 1, the ink 3 may flow out of the air vent 8. However, in the ink cartridge 101 of this embodiment, the ink 3 that overcomes the capillary pressure of the porous member 70 and passes through the third chamber 3 flows into the second chamber 20 via the second end 32. The second chamber 20 serves as a reservoir that temporarily retains the ink 3. When the ink cartridge 101 is kept upright, external leakage of the ink 3 does not occur provided that the volume of the ink 3 that has passed through the third chamber 30 is less than that of the second chamber 20. The ink cartridge 101 may turn upside down during transportation. In this case, the ink 3 may flow out of the air vent 60. However, since the ink cartridge 101 of this embodiment has the selective permeable member 80, the external leakage of the ink 3 from the second chamber 20 is prevented.

Figure 3:
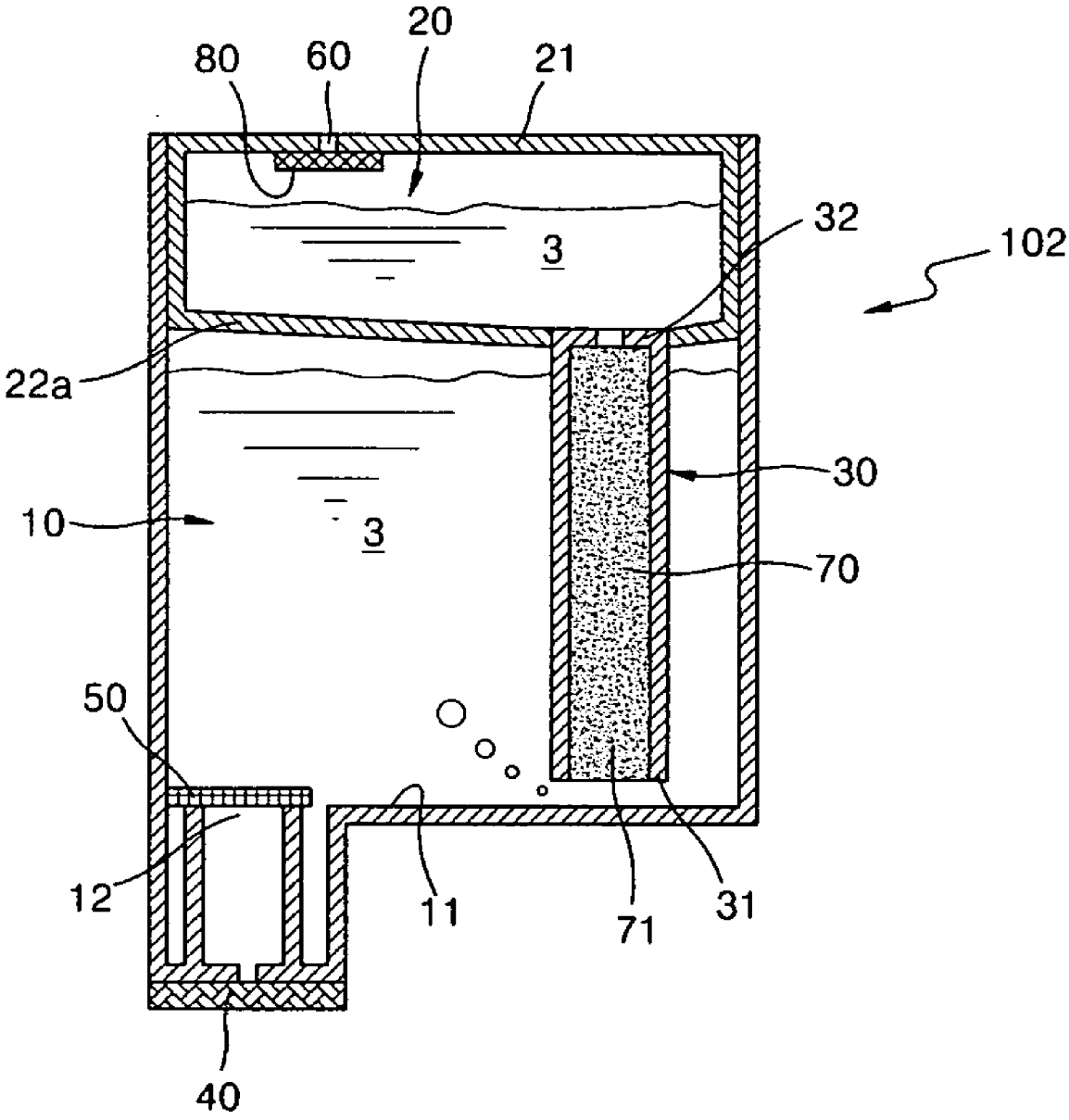
FIG. 3 is a sectional view showing a modified example of the ink cartridge of FIG. 2.

FIG. 3 is a sectional view showing a modified example of the ink cartridge of FIG. 2.

Referring to FIG. 3, a lower wall 22*a* of the second chamber 20 slants downward toward the second end 32 of the third chamber 30. Here, the same reference numerals as in FIG. 2 indicate the same constitutional elements, and thus, overlapping descriptions are omitted.

An ink cartridge 102 with the above-described structure provides benefits in addition to the advantages described in connection with the embodiment of FIG. 2. After the ink 3 in the first chamber 10 is introduced into the second chamber 20 via the third chamber 30 due to a change in external environment, when the external environment is returned to a normal state, the ink 3 in the second chamber 20 returns to the first chamber 10 via the third chamber 30. At this time, when the lower wall 22*a* slants downward toward the second end 32 of the third chamber 30 as shown in FIG. 3, the ink 3 can spontaneously flow into the third chamber 30.

Figure 4:
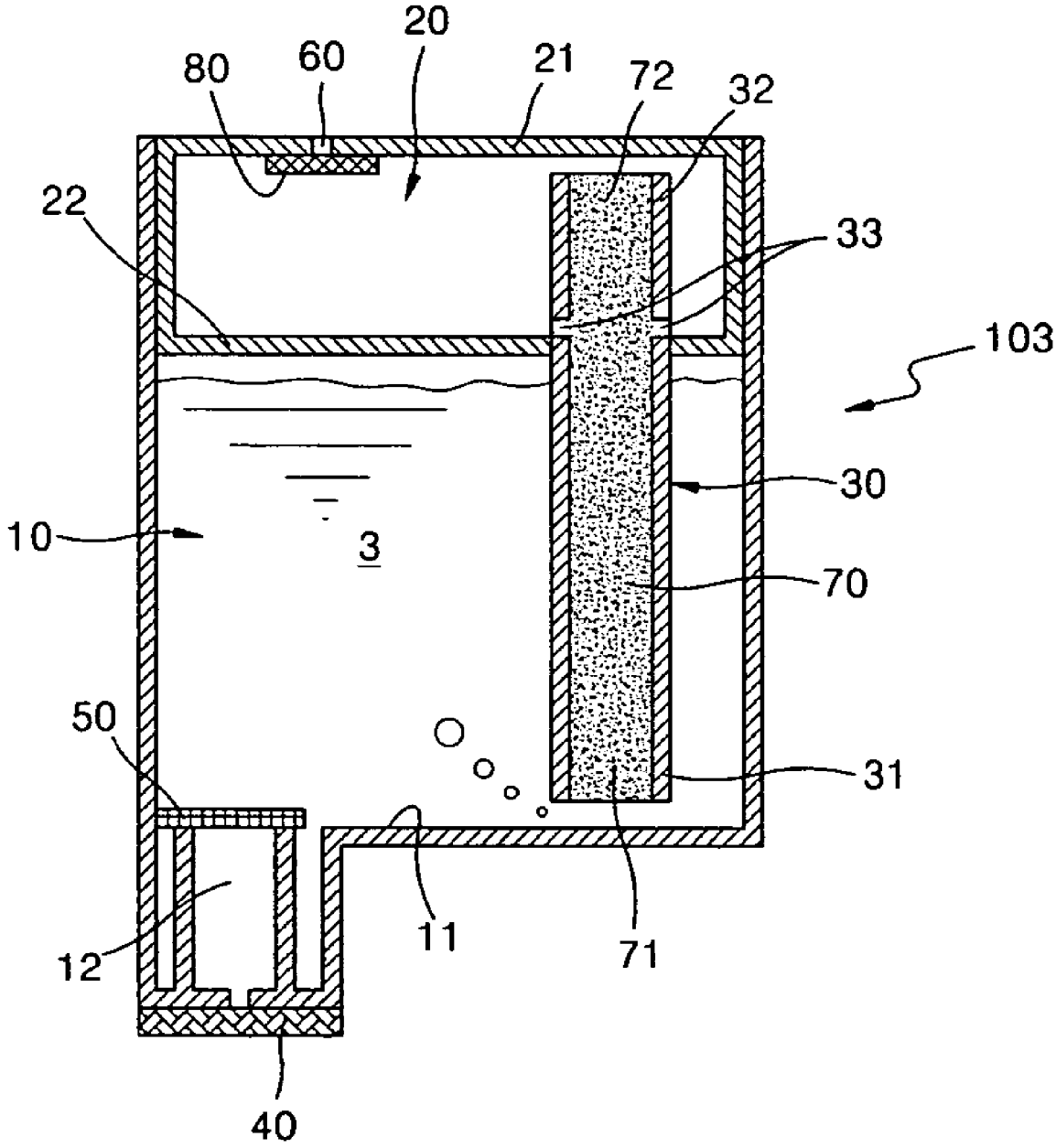
FIG. 4 is a sectional view of an ink cartridge according to another embodiment of the present invention.
Figure 5:
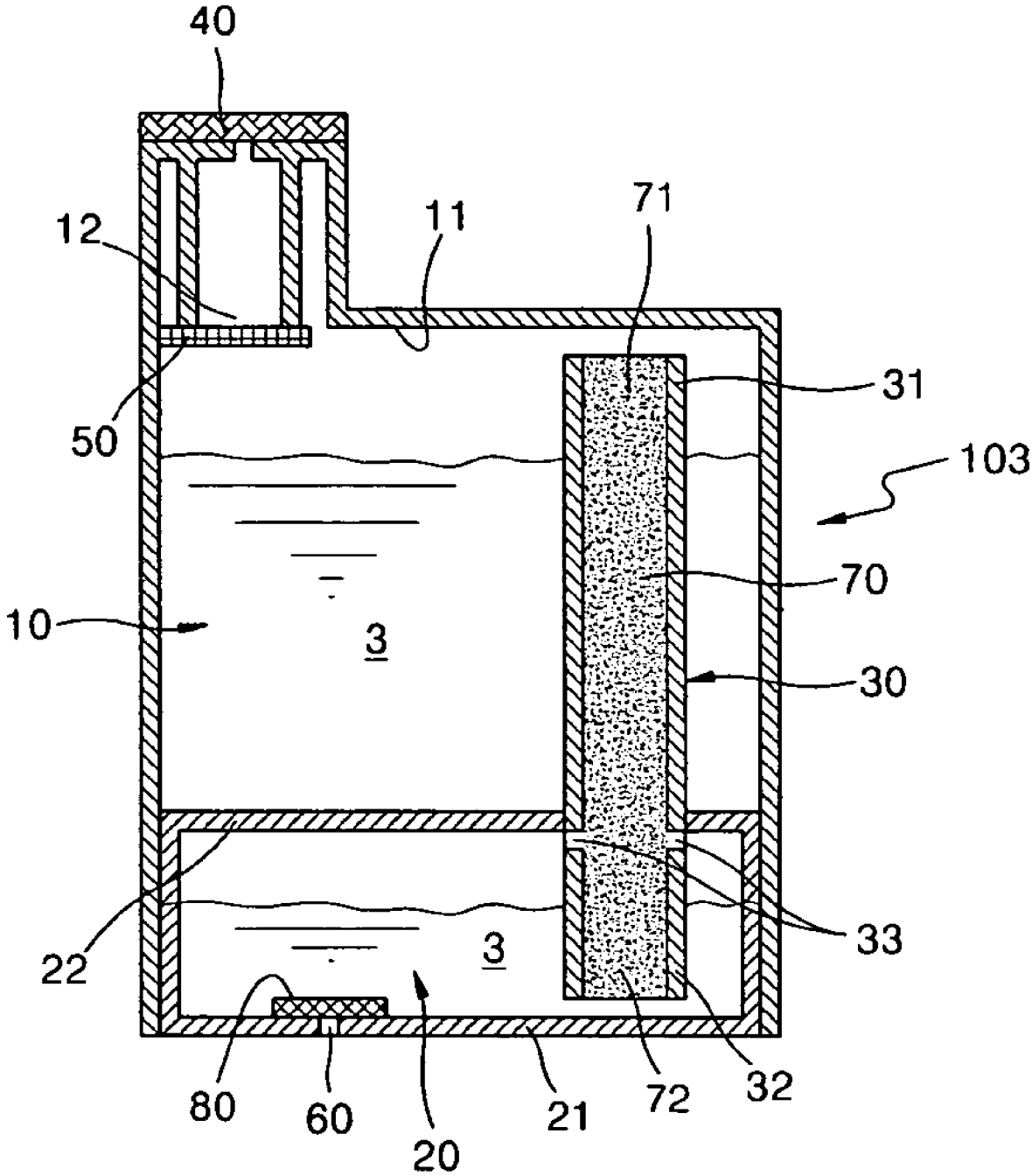
FIG. 5 is an inverted sectional view of the ink cartridge of FIG. 4.

FIG. 4 is a sectional view of an ink cartridge according to another embodiment of the present invention. FIG. 5 is an inverted sectional view of the ink cartridge of FIG. 4.

Referring to FIG. 4, the third chamber 30 passes through the lower wall 22 of the second chamber 20 and extends upward so that the second end 32 is separated from the upper wall 21 by a small gap, as compared to the third chamber 30 of FIG. 2. The other end 72 of the porous member 70 is separated from the upper wall 21 of the second chamber 20 by a small gap or contacts the upper wall 21 of the second chamber 20. The third chamber 30 further includes a second opening 33. The second opening 33 is positioned at almost the same height as the lower wall 22 of the second chamber 20 to allow communication between the third chamber 30 and the second chamber 20. Here, the same reference numerals as in FIG. 2 indicate the same constitutional elements, and thus, overlapping descriptions are omitted.

An ink cartridge 103 with the above-described structure provides benefits in addition to the advantages described in connection with the embodiment shown in FIG. 2. After the ink 3 in the first chamber 10 is introduced into the second chamber 20 via the third chamber 30 due to a change in external environment, when the external environment is returned to a normal state, the ink 3 in the second chamber 20 returns to the first chamber 10. At this time, when the ink cartridge 103 is kept upright as shown in FIG. 4, the ink 3 in the second chamber 20 is returned to the first chamber 10 via the third chamber 30 through the second opening 33. Even when the ink cartridge 103 turns upside down as shown in FIG. 5, the ink 3 in the second chamber 20 can be returned to the first chamber 10 after being introduced into the third chamber 30 through the second end 32. When the ink cartridge 103 turns upside down as shown in FIG. 5, the other end 72 of the porous member 70 is contacted to the upper wall 21 of the second chamber 20, which is helpful for returning the ink 3 to the first chamber 10.

Figure 6:
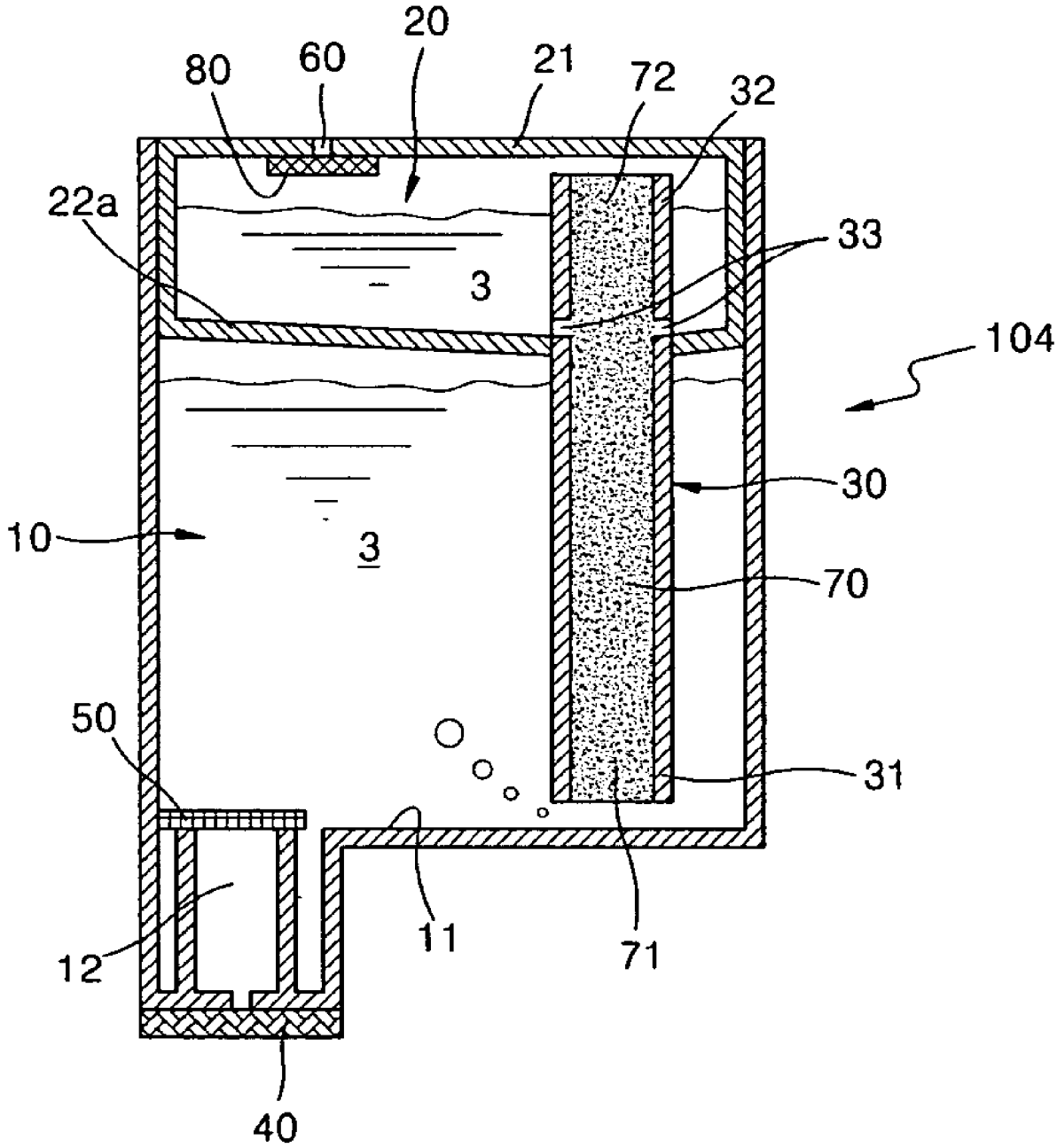
FIG. 6 is a sectional view showing a modified example of the ink cartridge of FIG. 4.

FIG. 6 shows a modified example of the ink cartridge of FIG. 4.

Referring to FIG. 6, a lower wall 22*a* of the second chamber 20 slants downward toward the second opening 33 of the third chamber 30. Here, the same reference numerals as in FIG. 4 indicate the same constitutional elements, and thus, overlapping descriptions are omitted. In an ink cartridge 104 with the above-described structure, like in FIG. 3, the ink 3 can spontaneously flow into the third chamber 30 from the second chamber 20 and then return to the first chamber 10.

As should be apparent from the above descriptions, an ink cartridge according to an embodiment of the present invention includes a second chamber and selective permeable member, thereby preventing the leakage of ink due to a change in external environment.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An ink cartridge comprising:

a first chamber, which retains ink and communicates with a print head;

a second chamber with an air vent;

a third chamber, which comprises a first end communicating with the first chamber, and a second end communicating with the second chamber and is substantially filled with a porous member creating a negative pressure by capillary action; and a selective permeable member installed at the air vent, which allows inflow of air and prevents outflow of the ink, wherein ink is adapted to be supplied to the print head without passing through the second or third chambers.

2. The ink cartridge of claim 1, wherein the second chamber is positioned above the first chamber.

3. An ink cartridge comprising:

a first chamber, which retains ink and communicates with a print head;

a second chamber with an air vent;

a third chamber, which comprises a first end communicating with the first chamber and a second end communicating with the second chamber and is substantially filled with a porous member creating a negative pressure by capillary action; and a selective permeable member installed at the air vent, which allows inflow of air and prevents outflow of the ink, wherein ink is adapted to be supplied to the print head without passing through the second or third chambers, wherein the second chamber is positioned above the first chamber, and wherein the second chamber comprises a lower wall slanting downward toward the second end of the third chamber.

4. An ink cartridge comprising:

a first chamber, which retains ink and communicates with a print head;

a second chamber with an air vent;

a third chamber, which comprises a first end communicating with the first chamber and a second end communicating with the second chamber and is substantially filled with a porous member creating a negative pressure by capillary action; and a selective permeable member installed at the air vent, which allows inflow of air and prevents outflow of the ink, wherein ink is adapted to be supplied to the print head without passing through the second or third chambers, wherein the second chamber is positioned above the first chamber, and wherein the second end of the third chamber is adjacent to an upper wall of the second chamber and the third chamber has an opening that communicates with the second chamber and is adjacent to a lower wall of the second chamber.

5. The ink cartridge of claim 4, wherein a lower end and an upper end of the porous member are respectively contacted to the lower wall of the first chamber and the upper wall of the second chamber.

6. The ink cartridge of claim 4, wherein the lower wall of the second chamber slants downward toward the opening.

7. The ink cartridge of claim 6, wherein a lower end and an upper end of the porous member respectively contact the lower wall of the first chamber and the upper wall of the second chamber.

* * * * *